US005992845A

United States Patent [19]

Fendler et al.

[11] Patent Number: 5,992,845

[45] Date of Patent: Nov. 30, 1999

[54] SHEET-GUIDING DEVICE WITH A COOLED SHEET-GUIDING PLATE

[75] Inventors: Wolfram Fendler, Bensheim; Matthias Schuster, Heidelberg; Burkhard Mack, Brühl; Bernhard Waltenberger, Mannheim, all of Germany

[73] Assignee: Heidelberger Druckmaschinen, Aktiengesellschaft, Germany

[21] Appl. No.: 08/789,487

[22] Filed: Jan. 27, 1997

[30] Foreign Application Priority Data

Jan. 25, 1996 [DE] Germany ..... 196 02 514

[51] Int. Cl.[6] ..... B65H 29/24

[52] U.S. Cl. ..... 271/195

[58] Field of Search ..... 34/429, 611, 614, 34/629, 634, 636, 639, 654; 101/183, 230, 231, 232; 271/97, 194, 195, 204, 225

[56] References Cited

U.S. PATENT DOCUMENTS

| | | | |
|---|---|---|---|
| 3,936,953 | 2/1976 | Chance et al. | 34/654 |
| 4,003,568 | 1/1977 | Stange et al. | 271/225 |
| 4,603,490 | 8/1986 | Hilmersson et al. | 34/629 |
| 4,763,424 | 8/1988 | Taylor et al. | 34/629 |
| 5,370,289 | 12/1994 | Helms et al. | 34/654 |
| 5,497,987 | 3/1996 | Henn et al. | 271/204 |
| 5,598,779 | 2/1997 | Haas et al. | 101/230 |
| 5,647,882 | 7/1997 | Thiessen | 34/639 X |
| 5,687,964 | 11/1997 | Stephan et al. | 271/195 |
| 5,787,810 | 8/1998 | Stephan | 271/195 X |
| 5,803,448 | 9/1998 | Stiel et al. | 271/195 |

FOREIGN PATENT DOCUMENTS

| | | |
|---|---|---|
| 70.00185 | 10/1971 | France . |
| 9418358 | 2/1995 | Germany . |

*Primary Examiner*—Henry Bennett
*Assistant Examiner*—Steve Gravini
*Attorney, Agent, or Firm*—Herbert L. Lerner; Laurence A. Greenberg

[57] ABSTRACT

A sheet-guiding device with a cooled sheet-guiding plate formed with air outlet openings, the sheet-guiding plate having a sheet-guiding surface on one side thereof and being connected, at the other side thereof opposite to the one side, to coolant ducts permitting the air outlet openings to remain freely open, and a cooling-duct plate having deformations forming the coolant ducts, the cooling-duct plate being connected by welding to the sheet-guiding plate and being sealed with respect thereto, includes a sealing element disposed between the other side of the sheet-guiding plate and the cooling-duct plate, the sealing element being in a groove-shaped indentation formed in the cooling-duct plate and surrounding a respective air outlet opening, and welding zones located in the vicinity of the sealing element for forming a connection between the sheet-guiding plate and the cooling-duct plate by weldments.

5 Claims, 2 Drawing Sheets

SHEET-GUIDING DEVICE WITH A COOLED SHEET-GUIDING PLATE

BACKGROUND OF THE INVENTION

1. Field of the Invention:

The invention relates to a sheet-guiding device with a cooled sheet-guiding plate formed with air outlet openings, the sheet-guiding plate having a sheet-guiding surface on one side thereof and being connected, at the other side thereof opposite to the one side, to coolant ducts permitting the air outlet openings to remain freely open, and a cooling-duct plate having deformations forming the coolant ducts, the cooling-duct plate being connected by welding to the sheet-guiding plate and being sealed with respect thereto.

Such a sheet-guiding device has become known heretofore from the published German Patent Document DE 94 18 358 U1. The sheet-guiding device disclosed in this German patent publication is formed of a perforated sheet-guiding plate, an air chamber located beneath the sheet-guiding plate, and a cooling system provided in the air chamber directly beneath the sheet-guiding plate, the cooling system being formed of cooling ducts through which water flows. The cooling ducts are constructed as troughs or channels open at the upper side thereof, and are welded to the rear side or underside of the sheet-guiding plate. The cooling ducts are so arranged that air outlet openings formed in the sheet-guiding plate are not covered thereby, and so that, via the air outlet openings, blast air may leave the air chamber beneath the sheet being conveyed over the sheet-guiding plate and may be aspirated or sucked away, if necessary.

Sheet-guiding devices of the type according to the invention are required to provide a sheet-guiding surface which is cooled as uniformly and optimally as possible and, even under varying temperatures, to provide a reliable separation of the coolant from the air in the air chamber. The sheet-guiding plate should have a smooth surface and ought not to have any tendency to deform due to varying temperatures. On the other hand, the sheet-guiding plate should have an overall height which is as small as possible, and have a relatively low weight, it should be relatively easy to assemble and should be manufacturable with a minimal possible effort or expense.

SUMMARY OF THE INVENTION

It is accordingly an object of the invention to provide a sheet-guiding device with a cooled sheet-guiding plate of the aforementioned type requiring only little overall height which is economically manufacturable and, even when in operation, maintains a smooth sheet-guiding surface which may be uniformly cooled in order to achieve great operational reliability in fast production runs of high-speed presses. With the foregoing and other objects in view, there is provided, in accordance with the invention, a sheet-guiding device with a cooled sheet-guiding plate formed with air outlet openings, the sheet-guiding plate having a sheet-guiding surface on one side thereof and being connected, at the other side thereof opposite to the one side, to coolant ducts permitting the air outlet openings to remain freely open, and a cooling-duct plate having deformations forming the coolant ducts, the cooling-duct plate being connected by welding to the sheet-guiding plate and being sealed with respect thereto, comprising a sealing element disposed between the other side of the sheet-guiding plate and the cooling-duct plate, the sealing element being in a groove-shaped indentation formed in the cooling-duct plate and surrounding a respective air outlet opening, and welding zones located in the vicinity of the sealing element for forming a connection between the sheet-guiding plate and the cooling-duct plate by weldments.

In accordance with another feature of the invention, the weldments are selected from the group consisting of spot weldments, laser weldments and pulse or capacitor-discharge weldments.

In accordance with a further feature of the invention, the groove-shaped indentation annularly surrounds the respective air outlet opening, and the sealing element is a pre-fabricated sealing ring received in the annular indentation.

In accordance with an added feature of the invention, the welding zones are located adjacent and on both sides of the respective annular groove-shaped indentation wherein the sealing ring is received.

In accordance with a concomitant feature of the invention, in vicinity of the air outlet openings formed in the sheet-guiding plate, the cooling-duct plate is provided with cutouts and is formed with the annular groove-shaped indentations, respectively, surrounding the respective cutouts and receiving a respective sealing ring therein, the welding zones being located adjacent and radially outside and inside the sealing ring, even and flush with the sheet-guiding plate.

Thus, an essential feature of the invention is that in the air chamber a sealing element is provided between the coolant or cooling agent and the air, the sealing element permitting spot-welding or pulse welding (capacitor-discharge welding) which ensures a sufficiently firm connection between the actual sheet-guiding plate and the cooling-duct plate wherein the cooling ducts containing the cooling agent are formed. Preferably, a soft rubber ring is used as the sealing element, in particular an O-ring having a low Shore hardness. As a result thereof, the heat development produced by the welding may be kept extremely low and does thus not influence in any way the surface of the sheet-guiding plate guiding a respective sheet. To reduce the manufacturing costs, the pre-fabricated O-rings are inserted in grooves formed in the cooling-duct plate, the spot welding is then performed either on one side in the vicinity of a respective inserted sealing ring or preferably on both sides thereof. For this purpose, a cooling-duct plate is provided with indentations in the form of grooves, the cooling-duct plate having cutouts formed therein in the vicinity of the air outlets formed in the sheet-guiding plate, with a respective groove surrounding a respective cutout in order to receive a sealing ring therein, and welding zones are provided on both sides of the sealing ring and so as to be even and flush with the sheet-guiding plate. The structural embodiment of the inventive features provides a uniform and optimally cooled sheet-guiding surface by maintaining a reliable separation of the coolant or cooling agent and the air contained in the air chamber, even for varying temperatures. Neither during the manufacture of the sheet-guiding plate nor the use of the sheet-guiding device during varying temperatures is the connection between the sheet-guiding plate and the cooling-duct plate achieved by spot welding, laser welding or pulse welding (capacitor-discharge welding) subject to any undesired deformations.

Other features which are considered as characteristic for the invention are set forth in the appended claims.

Although the invention is illustrated and described herein as embodied in a sheet-guiding device with a cooled sheet-guiding plate, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
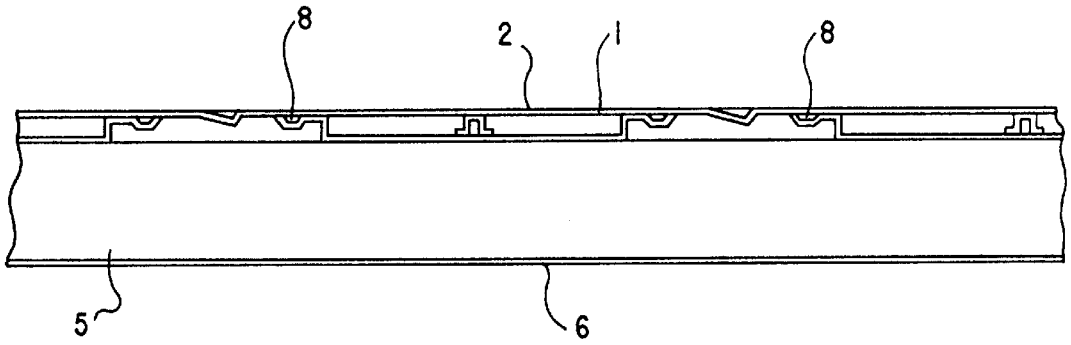
FIG. 1 is a diagrammatic cross-sectional view of a sheet-guiding device having the features according to the invention.
Figure 2:
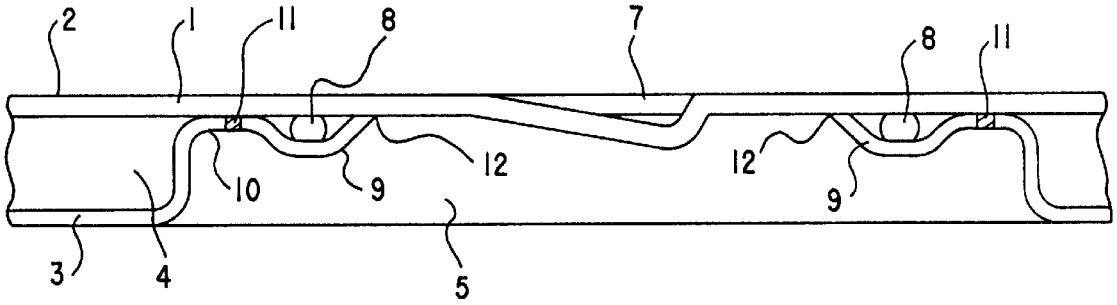
FIG. 2 is an enlarged fragmentary view of FIG. 1 showing a one-side welded connection between a sheet-guiding plate and a cooling-duct plate of the sheet-guiding device.
Figure 3:
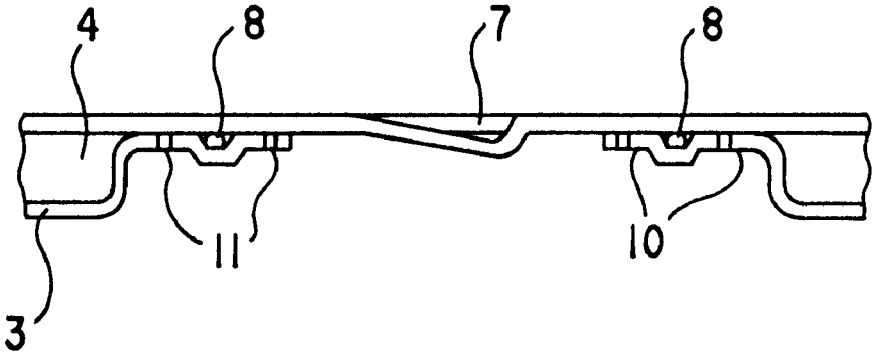
FIG. 3 is an enlarged fragmentary view of FIG. 1 showing a two-side welded connection between the sheet-guiding plate and the cooling-duct plate.
Figure 4:
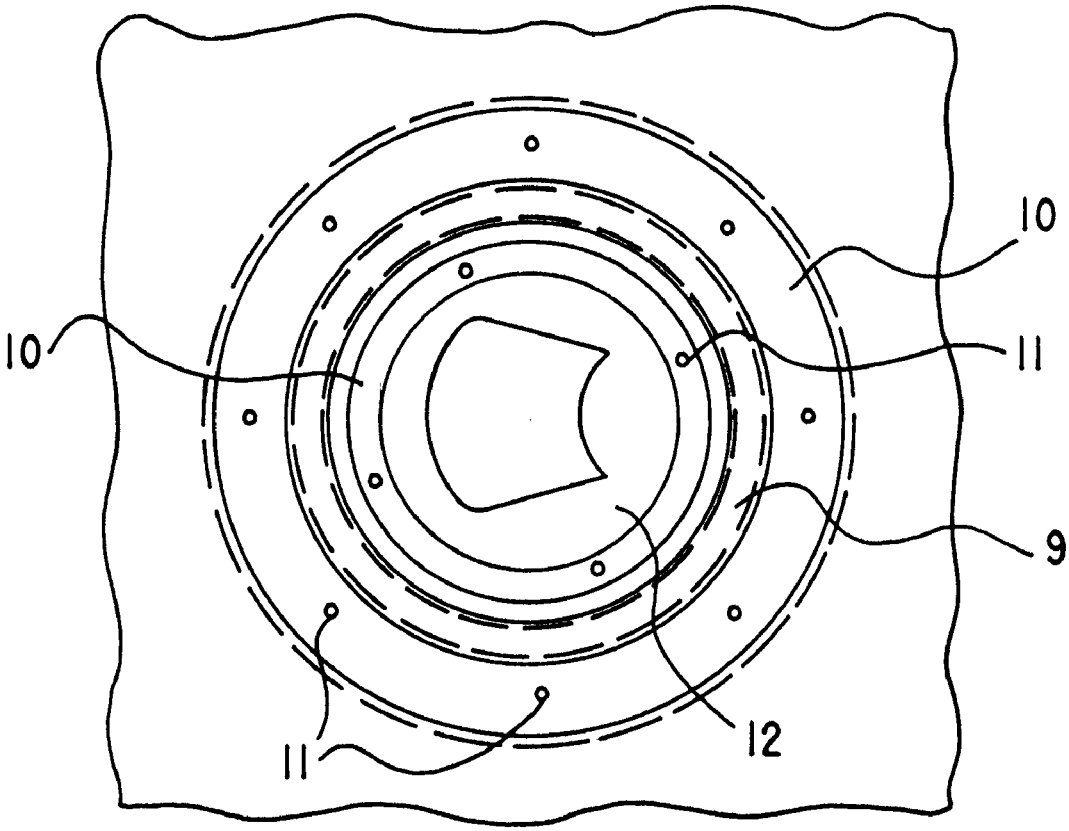
FIG. 4 is a bottom plan view of FIG. 3 showing in greater detail the cooling-duct plate of the embodiment of the sheet-guiding device illustrated therein.

Referring now to the drawings and, first, particularly to FIGS. 1 and 2 thereof, there is shown, in a sheet-guiding device, a sheet-guiding plate 1 having a surface which serves as a sheet-guiding surface 2 for sheets being conveyed over the sheet-guiding device. On the underside of the sheet-guiding plate 1, opposite the sheet-guiding surface 2, a cooling-duct plate 3 is connected to the sheet-guiding plate 1, the cooling-duct plate 3 being formed of a cooling system 4 with cooling ducts containing a coolant or cooling agent. The cooling system 4 is disposed in an air chamber 5 formed or defined by a further plate 6. Between the cooling ducts of the cooling system 4, air outlet openings 7 are formed in the sheet-guiding plate 1 and, in the embodiment shown, the air outlet openings 7 are formed by tongue-shaped incisions through which air may be blown, through a cutout 12 formed in the cooling-duct plate, from the air chamber 5 beneath a respective non-illustrated sheet being conveyed over the sheet-guiding surface 2. A sealing element is provided for sealing the cooling agent contained in the cooling ducts of the cooling system from the air contained in the air chamber 5. In the illustrated embodiment, the sealing element is formed of a soft rubber cord or, preferably, a soft rubber ring 8 which is inserted in a groove-shaped indentation 9 formed in the cooling-duct plate 3. According to the embodiment of FIG. 2, a welding zone 10 is provided on one side and in the vicinity of the groove-shaped indentation 9 wherein a sealing ring 8 is inserted, so as to be even and flush with respect to the sheet-guiding plate 1. In accordance with the embodiment of FIGS. 3 and 4, such a welding zone 10 is provided on both sides, i.e., the radially outer and the radially inner sides, of the groove-shaped indentation 9 holding the inserted sealing ring 8. In the one-side or two-side welding zones, the sheet-guiding plate 1 and the cooling-duct plate 3 are connected to one another by mutually spaced-apart welding spots 11. The air chamber 5 is connected to the non-illustrated air-supply system of the printing press in a conventional manner and may be supplied both with excess pressure and vacuum or under-pressure.

We claim:

1. A sheet-guiding device with a cooled sheet-guiding plate formed with air outlet openings, the sheet-guiding plate having a sheet-guiding surface on one side thereof and being connected, at the other side thereof opposite to the one side, to coolant ducts permitting the air outlet openings to remain freely open, and a cooling-duct plate having deformations forming the coolant ducts, the cooling-duct plate being connected by welding to the sheet-guiding plate and being sealed with respect thereto, comprising a sealing element disposed between the other side of the sheet-guiding plate and the cooling-duct plate, said sealing element being in a groove-shaped indentation formed in said cooling-duct plate and surrounding a respective air outlet opening, and welding zones located in the vicinity of said sealing element for forming a connection between the sheet-guiding plate and the cooling-duct plate by weldments.

2. The sheet-guiding device according to claim 1, wherein said weldments are selected from the group consisting of spot weldments, laser weldments and pulse or capacitor-discharge weldments.

3. The sheet-guiding device according to claim 1, wherein said groove-shaped indentation annularly surrounds the respective air outlet opening, and said sealing element is a prefabricated sealing ring received in said annular indentation.

4. The sheet-guiding device according to claim 3, wherein said welding zones are located adjacent and on both sides of the respective annular groove-shaped indentation wherein said sealing ring is received.

5. The sheet-guiding device according to claim 4, wherein, in vicinity of the air outlet openings formed in the sheet-guiding plate, the cooling-duct plate is provided with cutouts and is formed with the annular groove-shaped indentations, respectively, surrounding the respective cutouts and receiving a respective sealing ring therein, the welding zones being located adjacent and radially outside and inside said sealing ring, even and flush with the sheet-guiding plate.

* * * * *